United States Patent [19]

Campoli

[11] Patent Number: 4,640,195

[45] Date of Patent: Feb. 3, 1987

[54] ROCKET LAUNCHING CARTRIDGE CASE AND ASSEMBLY

[75] Inventor: Ralph F. Campoli, Dover, N.J.

[73] Assignee: General Defense Corporation, Wharton, N.J.

[21] Appl. No.: 851,898

[22] Filed: Apr. 11, 1986

Related U.S. Application Data

[63] Continuation of Ser. No. 565,655, Dec. 27, 1983, abandoned.

[51] Int. Cl.[4] ..... F42B 5/02

[52] U.S. Cl. ..... 102/430; 102/376; 102/520

[58] Field of Search ..... 102/374, 376, 520–528, 102/430, 439

[56] References Cited

U.S. PATENT DOCUMENTS

| | | | |
|---|---|---|---|
| 607,868 | 7/1898 | Mauser | 102/430 |
| 2,884,859 | 5/1959 | Alexander et al. | 102/376 |
| 3,815,503 | 6/1974 | Infantino | 102/374 |
| 3,842,739 | 10/1974 | Scanlon et al. | 102/467 |
| 3,990,366 | 11/1976 | Scanlon | 102/467 |
| 4,242,961 | 1/1981 | Moredock et al. | 102/527 |

FOREIGN PATENT DOCUMENTS

| | | | |
|---|---|---|---|
| 705557 | 5/1941 | Fed. Rep. of Germany | 102/520 |

*Primary Examiner*—Harold J. Tudor

*Attorney, Agent, or Firm*—Finnegan, Henderson, Farabow, Garrett & Dunner

[57] ABSTRACT

A rocket launching cartridge case is formed by attaching a cylindrical extension member to the open end of a cartridge case. The extension member conforms to cartridge receiving chambers of conventional weapons. A rocket assembly is releasably locked within the extension member at a predetermined axial position. The rocket assembly can be slideably positioned within the extension member and locked in place prior to attachment of the extension member to the cartridge case. The locking means establishes a rocket assembly and launching case overall length for use in particular conventional weapons. An obturator member on the rocket assembly engages rifling in the conventional weapon bore imparting a stabilizing spin when the rocket assembly is fired. The obturator is connected to the rocket assembly in a manner permitting slip rotation therebetween providing a predetermined rate of stabilizing spin. The extension member and the obturator have surfaces functioning as gas seals during launching of the rocket assembly.

18 Claims, 8 Drawing Figures

ROCKET LAUNCHING CARTRIDGE CASE AND ASSEMBLY

This application is a continuation of application Ser. No. 565,655, filed Dec. 27, 1983, now abandoned.

BACKGROUND OF THE INVENTION

The present invention relates to a rocket launching cartridge case and assembly formed to fit within the rifle chamber of a conventional weapon such as a tank gun. More specifically a conventional cartridge case is modified to include a cylindrical extension member forming a rocket launching case capable of receiving a rocket assembly having a length longer than the usual cartridge projectile.

Technological developments continually result in improvement of materials resisting penetration by high velocity projectiles. As the armor piercing resistance characteristics of these materials improve an increase in muzzle velocity is necessary to obtain penetration. Achieving these required higher velocities with present ammunition and weapon systems has become a serious problem. New weapons capable of launching high mass projectiles at increased velocity have become inordinately costly and time consuming. A decrease in the weight of the round itself to increase muzzle velocity is practically impossible because present designs have already stripped excess weight from the round structure such that in the interest of safety further materials cannot be removed. In view of these limitations of conventional rounds it appears they will become obsolete with respect to future developments in armor plate.

One solution to the limitation on muzzle velocity of conventional rounds is utilization of a rocket powered projectile. Initial launching of the rocket assembly requires a relatively small amount of propellant charge. The major disadvantage of use of a rocket assembly in conjunction with a conventional weapon is its overall length. Additionally, the use of a rocket assembly in a conventional weapon system such as that used in a tank involves storage problems. These storage problems are likewise due to the overall length of the rocket assembly.

Accordingly it is a primary object of this invention to provide a rocket launching cartridge case permitting firing of a rocket propelled projectile from a conventional weapon.

It is a further object of this invention to provide a rocket launching cartridge case including a modified cartridge case permitting firing of a rocket propelled projectile.

A further object of this invention is the provision of a rocket launching cartridge case releasably receiving a rocket motor therein for firing from a conventional weapon.

A still further object of this invention is the provision of a rocket launching cartridge case retaining a rocket assembly at a predetermined depth within the cartridge case resulting in a specific overall round length.

Other. objects and features of the present invention will further become apparent hereinafter with reference to the accompanying drawings and detailed description of the invention.

SUMMARY OF THE INVENTION

To achieve the foregoing objects in accordance with the purposes of this invention, as embodied and broadly described herein, the rocket launching cartridge case and assembly of this invention comprises a cartridge case having a closed primer end and an open end; a cylindrical extension member secured to the open end forms a rocket launching case; the cylindrical extension member conforms to the cartridge chamber of a conventional weapon and slidably receives a rocket assembly; locking means in the form of a protrusion engaging a groove, one being on the inner surface of the cylindrical extension member and the other being on the exterior surface of the rocket motor, releasably position the rocket motor at a predetermined depth within the launching case; the locking means is positioned to provide a predetermined overall length while also providing space for placing a charge beneath the rocket assembly within the cartridge case for initially launching the rocket.

Reference will now be made in detail to the present preferred embodiment of the invention, an example of which is illustrated in the accompanying drawings.

DESCRIPTION OF THE PREFERRED EMBODIMENT

Figure 1:
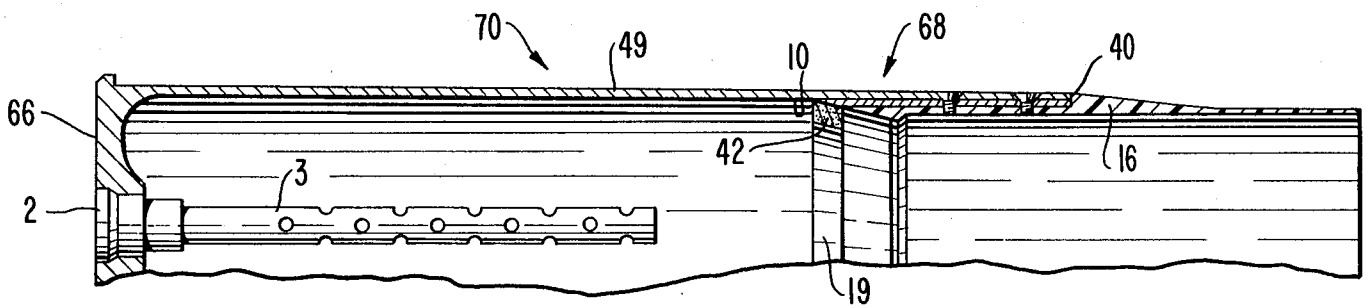
FIG. 1 is a partial sectional plan view of the rocket launching cartridge case of the invention.

With reference to FIG. 1, a cartridge case 49 is shown connected to a cylindrical extension member 16 forming rocket launching cartridge case 70. The cartridge case 49, which has been shortened from a standard length, includes closed end 66 receiving primer head 2 and primer tube 3, and cylindrical extension 16 is secured adjacent open end 40 of case 49. Inner sleeve 19 is inserted within open case end 40 and is permitted to expand by incorporation of slot 42 for precisely positioning the sleeve flush with the end of the open case end 40. Inner sleeve 19 is welded in place and slot 42 is closed with weld material to provide a seal between sleeve 19 and inner surface 10 of case 49.

Figure 2:
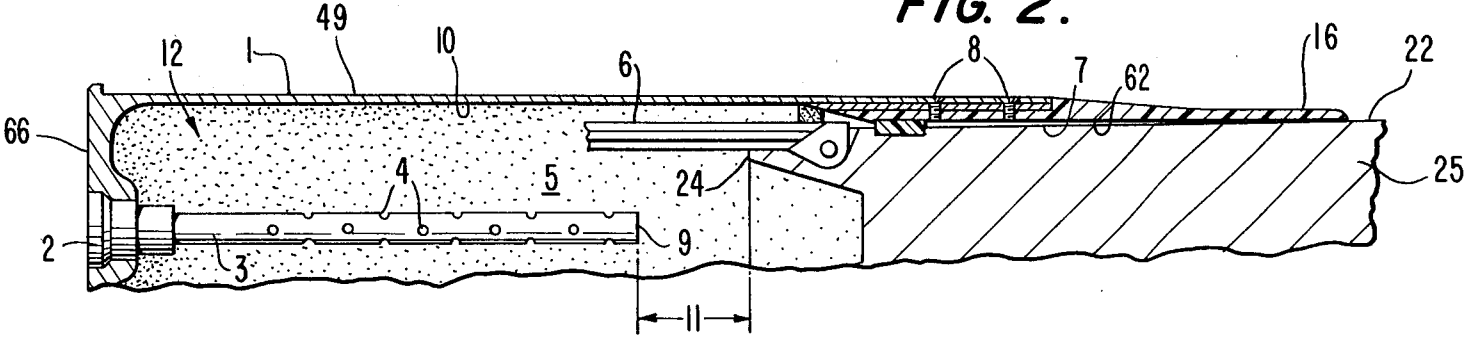
FIG. 2 is a partial sectional plan view of the rocket launching cartridge case assembly illustrating a rocket motor positioned within the rocket launching case of the invention.

Referring now to FIG. 2 rocket assembly 25 has an outer diameter 22 of a size to permit insertion within cylindrical extension 16. Inner diameter 62 of cylindrical extension 16 is slightly tapered to provide a predetermined relationship between extension member 16 and outer diameter 22 of the rocket assembly 25. Rocket motor 25 extends within cartridge case 49 to a predetermined position so that rocket nozzle end 24 cooperates with closed end 66 of case 49 forming chamber 5 having a predetermined volume. Propellant 12 is placed within the chamber 5 adjacent the primer tube 3, which contains flash holes 4 permitting firing of the propellant 12 for launching rocket assembly 25. A predetermined clearance 11 is maintained between end 9 of primer tube 3 and rocket nozzle end 24.

Figure 3:
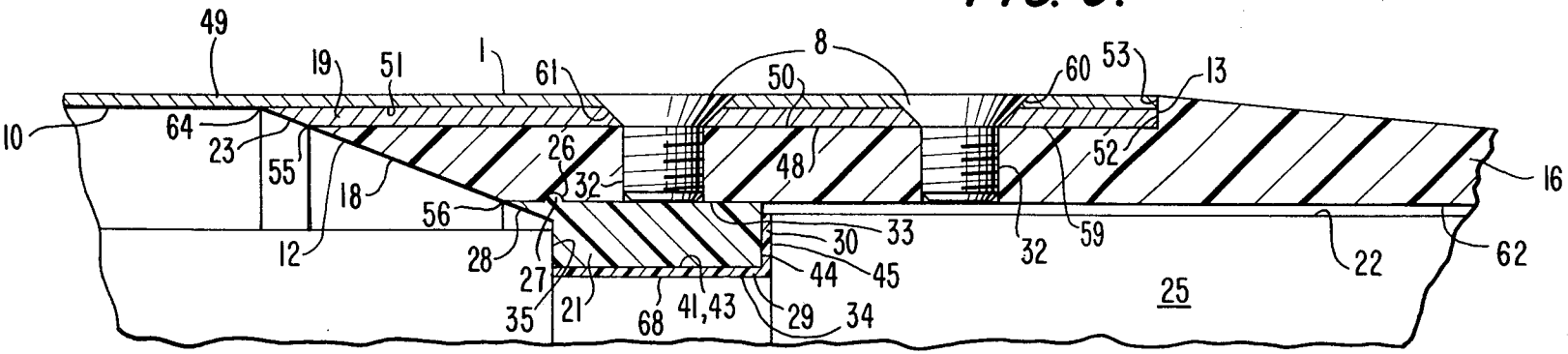
FIG. 3 is a partial sectional view of the rocket motor releasably connected to a cylindrical extension member of the subject invention.

With reference to FIG. 3, inner sleeve 19 is illustrated welded to the inner surface 10 of cartridge case 49 so that respective ends 52 and 53 are aligned and abuttingly engage end wall 13 of an area of reduced diameter 48 of extension member 16. Cartridge case 49, inner sleeve 19, and reduced diametrical portion 48 of extension 16 contain a plurality of aligned holes 60, 61 and 32, the holes in the cylindrical extension member 16 being threaded at 32 to receive screws 8 for securing the extension member 16 to a subassembly composed of inner sleeve 19 and cartridge case 49.

Figure 3A:
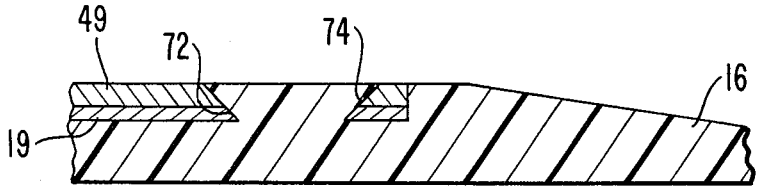
FIG. 3A is a fragmentary sectional view illustrating an alternate method of connecting the cylindrical extension member to the cartridge case when components are fabricated from molded material.
Figure 3B:
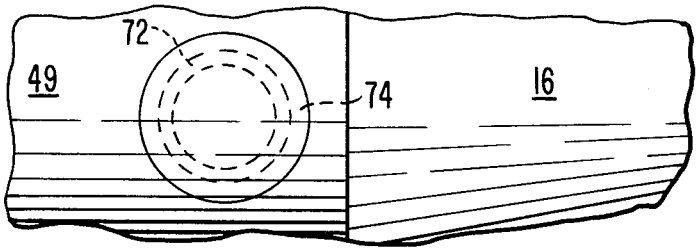
FIG. 3B is a fragmentary plan view further illustrating the connection shown in FIG. 3A.

While use of screws 8 to secure cylindrical extension member 16 to the cartridge case 49 is illustrated, it is apparent that many conventional methods could be used to secure these members together. For example, as shown in FIGS. 3A & 3B cartridge case 49 can be provided with a plurality of holes 72 having tapered side walls 74 adjacent open end 40 and member 16 can be molded and positioned such that the molded material flows into the holes 72 so that tapered side walls 74 rigidly secure member 16 within cartridge case 49. It is also apparent that various types of materials could be used to form the cylindrical extension 16. Any suitable plastic would suffice as long as it is capable of withstanding the pressures and temperatures generated during launch of rocket assembly 25. One such material is Nylon 101 which incorporates the aforementioned desirable characteristics.

Figure 3C:
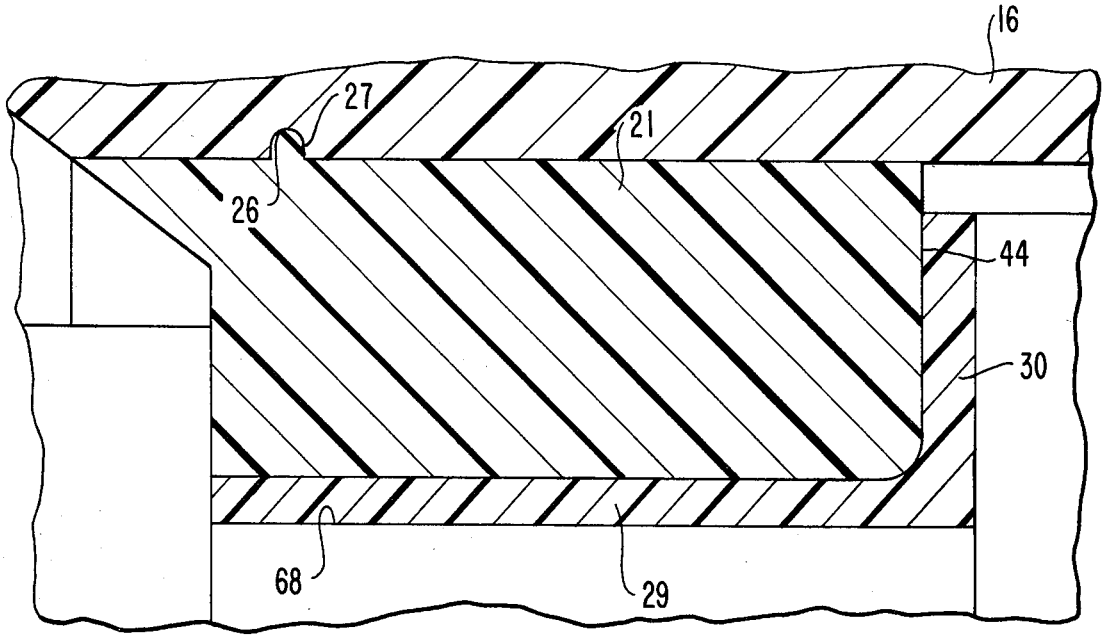
FIG. 3C is an enlarged view of a detail of a portion of the apparatus shown in FIG. 3.

With continued reference to FIG. 3 and FIG. 3C, rocket assembly 25 is formed to contain recess 68 for receipt of obturator ring sealing band 29. Sealing band 29 can be composed of a polypropylene plastic material and can be secured in place by a suitable adhesive such as TRA-BOND number 2129, the requirement being that the adhesive be sufficiently strong to retain the sealing band in place and have characteristics such that it can endure the heat and pressures generated during launch of the rocket assembly. Sealing band 29 includes an upwardly extending lip portion 30 engaging a forward face 44 of obturator ring 21 providing a gas-tight seal between rocket motor 25 and obturator ring 21. Obturator ring 21 can be formed of any suitable material such as NYLON 101 and is provided with an upwardly and rearwardly extending tapered surface 28. In a preferred embodiment, obturator 21 includes protrusion 27 in the form of an annular ridge. Likewise the inner surface 62 of extension member 16 is formed to include an annular recess 26 to frictionally receive protrusion 27. The engagement of protrusion 27 with recess 26 provides a means for locking obturator ring 21 to the inner surface of extension member 16 thereby retaining rocket motor 25 within the cylindrical extension member 16 to form the rocket assembly unit subassembly. In instances where the cylindrical extension member is inserted within the rocket launching cartridge case subassembly formed by inner sleeve 19 and cartridge case 49, cylindrical extension number 16 can be attached to rocket assembly 25 through engagement of protrusion 27 with recess 26 and this subassembly positioned within the aforementioned subassembly formed by inner sleeve 19 and case 49. The locking of protusion 27 within recess 26 provides the resistance necessary for good propellant ignition generating a sufficient rocket launching pressure in chamber 5.

Tapered end surface 23 of inner sleeve 19, tapered end surface 12 of cylindrical extension member 16, and tapered end surface 28 of obturator ring 21 all cooperate to form a uniform rearward facing surface as illustrated in FIG. 3. These tapered surfaces respectfully engage cartridge case inner surface 10 at point 64, and one another at points 55 and 56, and are responsive to gases generated in chamber 5 during launch to be forced radially outwardly to tightly seal these components at the aforesaid engaging points to prevent gas leakage during launch of rocket motor 25.

With regard to sealing band 29, use of an adhesive to secure the band in place is only illustrated for descriptive purposes. Obviously the band 29 can be secured in place by various conventional methods. As an example, the sealing band can be of a plastic material responsive to heat permitting it to be placed upon the rocket motor 25 in the recess 68 and then be heat shrunk to tightly engage rocket motor 25 in recess 68 without use of any other materials.

A significant function of sealing band 29 is to provide a predetermined slip relationship between obturator ring 21 and the outer surface of sealing band 29, and thus rocket assembly 25. It is desirable that the sealing band have a coefficient of friction considerably lower than that obtained through a metal to metal contact permitting obturator ring 21 to slip in a predetermined manner for a purpose later to be described.

Figure 4:
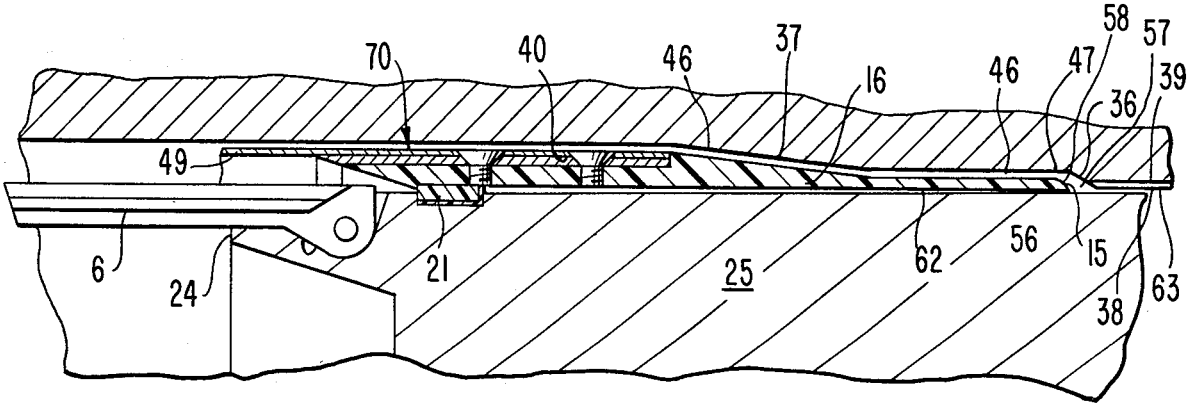
FIG. 4 is a partial sectional view further illustrating the rocket motor installed within the cylindrical extension member of the rocket launching cartridge case.

Referring to FIG. 4 rocket assembly 25 is shown disposed within cylindrical extension member 16 of the launching case assembly 70 while the outer surfaces of extension member 16 conform to surfaces 37 of a conventional weapon cartridge receiving chamber. Extension member 16 has a length, in conjunction with the length of cartridge case 49, providing a required clearance between end 15 of extension 16 and forcing cone portion 36 of chamber 37. This clearance permits some flexing of the end 15 during launching of rocket assembly 25 when obturator ring 21 engages rifling grooves 63 and is engraved to rotate rocket assembly 25 in a predetermined manner. The amount of rotation imparted to rocket assembly 25 during launching is regulated by the predetermined slip provided between obturator ring 21 and sealing band 29. A rocket assembly launched from the case 70 requires a lesser degree of rotation than would a conventional projectile because of utilization of stablizing fins such as fin 6 on the inner end 24 of rocket assembly 25. Obturator ring 21 is preferably of frangible material so that it fractures when the rocket assembly exits the muzzle of the bore of a conventional weapon.

Figure 5:
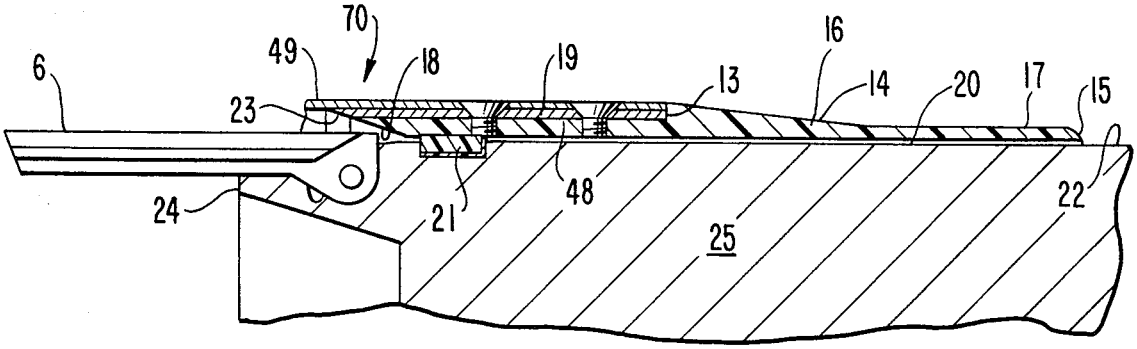
FIG. 5 is a partial sectional view illustrating the rocket motor installed within the cylindrical extension member forming a subassembly of the invention.

As indicated in FIGS. 2 and 5, the overall length of the launching cartridge case 70 and rocket assembly 25 is regulated by the degree of insertion of rocket assembly 25 within launching case 70. Inner sleeve 19 and the reduced diameter portion 48 of extension member 16 can be of varying lengths to permit positioning of the inner end of rocket motor 25 at a predetermined depth within the launching case 70. The only limitation upon the depth within the launching case assembly is the requirement that chamber 5 have a volume sufficient to receive enough propellant 12 to initially launch rocket assembly 25 from case 70. Likewise the distance between extension end 15 and the end wall 13 of extension 16 can be varied to conform to the cartridge chamber 37.

It will be apparent to those skilled in the art the various modifications and variations could be made in the components of the subject rocket launching cartridge case and assembly without departing from the scope or spirit of the invention. In particular various materials could be utilized to form the components of the subject launching cartridge case and assembly without departing from the scope of the invention, the only limitation being that the material is used have characteristics permitting them to withstand the severe heat and pressures generated during firing of the rocket assembly.

What is claimed is:

1. Apparatus for connecting a rocket assembly to a cartridge case of the type having a primer-receiving closed end and a projectile-receiving open end, for launching the rocket assembly from a conventional weapon, said rocket assembly having a rocket with a diameter conforming to the bore of the weapon, and also having a nozzle end, the rocket assembly being substantially greater in length than the projectile conventionally employed with the cartridge case in the weapon, the apparatus comprising:

a cylindrical extension member secureable to the cartridge case at the open end, said extension member and the cartridge case together conforming to the shape and dimensions of the cartridge receiving chamber of the weapon, said extension member also being configured to slideably receive the rocket assembly, wherein said extension member includes a portion having an axial bore of essentially constant diameter for receiving the rocket assembly, said extension member portion extending within said cartridge case past said open end, locking means associated with said extension member for releasably retaining the rocket assembly when the latter is inserted into said extension member, said locking means being forcefully releasable in response to the rocket assembly being launched;

the apparatus further including means associated with said extension member for positioning said rocket assembly within extension member bore to achieve a predetermined overall rocket round length, and sleeve means positioned between the cartridge case and said cylindrical extension member and expandingly engageable with the cartridge case for preventing leakage past said extension member of the gases generated in the cartridge case during launch of the rocket assembly.

2. The apparatus as in claim 1 wherein said sleeve means includes a sleeve member and means for precisely positioning said sleeve member in said case.

3. The apparatus as in claim 2 wherein said sleeve member positioning means includes a slot through the wall of said sleeve member along the axial length thereof, said sleeve member being resiliently deformable in the radial direction to allow insertion in said case, and said sleeve member being welded in place to said case, the weld material filling the residual slot gap.

4. The apparatus as in claim 1 wherein said sleeve means includes a sleeve member having a conically tapered end surface for expansion and sealing against said casing during rocket assembly launch.

5. The apparatus as in claim 4 wherein said cylindrical extension member has a conically tapered end surface cooperating with said sleeve member end surface to define, in part, a forcing cone.

6. Apparatus for launching a rocket assembly from a conventional weapon, said rocket assembly being substantially greater in length than projectiles conventionally fired from the weapon, the apparatus comprising:

a cartridge case having a primer-receiving closed end and an open end;

a sleeve member positioned within, and secured to, said case and having an end outwardly expandable for sealing propulsion gases within said cartridge case during launch of the rocket assembly;

a cylindrical extension member extending within said sleeve member;

means for securing said extension member to said cartridge case, with said case, said sleeve member, and said secured extension member together forming a rocket assembly launching case;

said launching case having a specific overall length to fit within the conventional weapon and having an exterior surface conforming to the bore of said weapon;

said launching case capable of slidably receiving the rocket assembly;

means associated with said extension member for positioning and locking a rocket assembly within said launching case;

said locking means retaining said rocket assembly at a predetermined depth within said launching case; and said locking means being forcefully released when said rocket is fired.

7. Apparatus for launching a rocket assembly as described in claim 6 wherein said cylindrical extension member is sized and configured to position a rocket assembly within said launching case with its nozzle end spaced from said cartridge case primer-receiving end to form a closed chamber, said chamber being filled with a propellant charge sufficient to initially launch the rocket assembly.

8. Apparatus for launching a rocket assembly as described in claim 6 wherein said cylindrical extension member is formed of a plastic material capable of withstanding heat and pressures generated during firing of the rocket.

9. Apparatus for launching a rocket assembly as described in claim 6 wherein said cylindrical extension member is formed of molded plastic material, and wherein said securing means includes an integral portion of said plastic extension member being captured in at least one aperture formed in said cartridge case.

10. The apparatus as in claim 9 wherein said integral plastic portion extends through an aperture in said sleeve member aligned with said cartridge case aperture.

11. Apparatus for launching a rocket assembly from a conventional weapon comprising: a first subassembly including a cartridge case of a predetermined length having a primer-receiving closed end and an open end;

an inner sleeve secured within said case adjacent said case open end for sealing propulsion gases within said cartridge case during rocket assembly launch; and a second subassembly including a rocket assembly;

a cylindrical extension member having an axial bore conforming to the outer diameter of said rocket assembly;

means for releasably locking said rocket assembly within said extension member bore in a predetermined axial relationship; and means for fastening said first and second subassemblies together to form a rocket launching cartridge case assembly unit, said releasable locking means positioning said rocket assembly within said rocket launching cartridge case to provide a desired overall unit length, the nozzle end of said rocket assembly and said standard cartridge case primer-receiving end cooperating to form a launch charge containing chamber.

12. Apparatus for launching a rocket assembly as described in claim 11 wherein said cylindrical extension member and said inner sleeve member have respective tapered end surfaces conically aligned with one another and expandable radially outwardly during rocket assembly launch for sealing propulsion gases.

13. Apparatus for launching a rocket assembly as described in claim 11 further including means for imparting a predetermined rate of stablizing spin to said rocket assembly when launched.

14. Apparatus for launching a rocket assembly as described in claim 11 wherein an obturator ring is mounted on said rocket assembly; said ring having an outer diameter greater than said rocket assembly with the ring circumferiental outer surface slidably engaging the inner surface of said cylindrical extension member and interferingly engaging the rifling grooves in the conventional weapon bore to impart a stablizing spin to said rocket assembly when launched.

15. Apparatus for launching a rocket assembly described in claim 11 wherein said locking means comprises an annular ridge on the outer circumferential surface of said obturator ring releasably received in an annular groove in the inner cylindrical surface of said extension member.

16. Apparatus for launching a rocket assembly as described in claim 14 wherein a sealing band is placed upon said rocket assembly and said obturator ring is mounted upon said band, said band preventing gas leakage between said rocket assembly and said obturator ring.

17. Apparatus for launching a rocket assembly as described in claim 16 wherein said sealing band is configured to provide a predetermined coefficient of friction between said obturator ring and said rocket assembly and to permit a limited degree of rotational slip when said obturator ring engages rifling in a bore of a conventional weapon.

18. Apparatus for launching a rocket assembly as described in claim 12 wherein said rocket assembly includes an obturator ring engaging said cylindrical extension member, and wherein said obturator ring also has a tapered inner end surface in conical alignment with said aligned cylindrical extension member end surface and said sleeve member end surface, for sealing propulsion gases during rocket assembly launch.

* * * * *